US007231972B2

(12) United States Patent
Gambier et al.

(10) Patent No.: US 7,231,972 B2
(45) Date of Patent: Jun. 19, 2007

(54) INTEGRAL FLUSH GAUGE CABLE APPARATUS AND METHOD

(75) Inventors: Philippe Gambier, Houston, TX (US); Emmanuel Rioufol, Lons (FR); Didier Pohl, Paris (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 226 days.

(21) Appl. No.: 10/906,336

(22) Filed: Feb. 15, 2005

(65) Prior Publication Data

US 2006/0180305 A1 Aug. 17, 2006

(51) Int. Cl.
*E21B 47/00* (2006.01)

(52) U.S. Cl. ..... 166/250.01; 166/250.17; 166/250.11; 166/66

(58) Field of Classification Search ..... 166/250.17, 166/250.11, 250.01, 66; 340/853.1
See application file for complete search history.

(56) References Cited

U.S. PATENT DOCUMENTS

| | | | | |
|---|---|---|---|---|
| 4,267,727 | A | 5/1981 | Hoppe | |
| 6,116,340 | A | 9/2000 | Wilson et al. | |
| 6,442,304 | B1 | 8/2002 | Crawley et al. | |
| 2002/0062958 | A1 * | 5/2002 | Diener et al. | 166/243 |
| 2004/0216872 | A1 * | 11/2004 | Foster et al. | 166/250.01 |
| 2005/0034873 | A1 * | 2/2005 | Coon et al. | 166/380 |
| 2005/0217848 | A1 * | 10/2005 | Edwards et al. | 166/285 |
| 2006/0027378 | A1 | 2/2006 | Zimmerman | |

FOREIGN PATENT DOCUMENTS

| | | | |
|---|---|---|---|
| DE | 9321286 | U1 | 1/1997 |
| GB | 2341679 | A | 3/2000 |
| GB | 2398805 | A | 9/2004 |
| WO | WO2004/079398 | A1 | 9/2004 |

* cited by examiner

*Primary Examiner*—David Bagnell
*Assistant Examiner*—David Andrews
(74) *Attorney, Agent, or Firm*—Dona C. Edwards; Bryan P. Galloway; Tim Curington

(57) ABSTRACT

The present invention includes a communications system to measure and transmit date from a zone of interest below a downhole assembly to a remote location. The communications system preferably includes a sensor gauge engaged through a communications port of the downhole assembly upon a communications cable whereby the communications cable and sensor gauge have substantially the same outer profile diameter.

29 Claims, 1 Drawing Sheet

INTEGRAL FLUSH GAUGE CABLE APPARATUS AND METHOD

BACKGROUND OF THE INVENTION

The present invention generally relates to a downhole gauge package integrated into a delivery and communications cable. More particularly, the present invention relates to a downhole gauge package integrated into a communications cable requiring no assembly and having a single uniform outer diameter.

Downhole sensor gauges are used throughout the petroleum drilling and recovery industry to measure and report various downhole conditions. Gauges that record and measure temperature, pressure, and other types of information are deployed to a location of interest downhole for either long or short-term emplacement. Particularly, one form of long-term emplacement involves the installation of a gauge below a packer to report a condition below the packer back to a remote location. Packers are frequently installed in petroleum industry wellbore to isolate one zone or region from another, adjacent zone or region. Particularly, packers can be used in petroleum production to isolate the annulus between a string of production tubing and a cased borehole to prevent the unwanted escape of production fluids.

Packers typically perform their functions by expanding an elastomeric packer element to fill any gaps between the production tube and the cased borehole. The packer element can be expanded by "inflating" the element with pressurized fluid or by activating the flexible element by axially compressing it between two pistons. Irrespective of construction or the deployment method used, the packer effectively creates a fluid seal between the production tubing and the remainder of the borehole.

However, while a production zone is isolated by a packer, downhole condition measurements are still necessary to determine the status of the isolated zone. While gauges (e.g. Temperature sensors and pressure transducers) can be deployed to the production zone through the bore of production tubing running through the packer, it is not preferred. Sensors that run through the production tubing bore can restrict the flow of production fluids or can interfere with the operation of production equipment located at the distal end of the production tubing. Furthermore, various pieces of equipment, for example downhole safety valves, require an unobstructed bore to be effective or to be in compliance with regulations.

To accommodate sensor gauges, packer designs have formerly been produced that allow a conduit to pass through the production tubing-casing annulus and bypass the packer element. These former designs typically involve a port through the body of the packer through which a constant diameter communications conduit can pass. Seals inside the port seal with the outer profile of the communications conduit and therefore prevent fluids from escaping from or invading into the production zone. Because of the design of the seals, the communications conduit has to be of a substantially consistent outer profile. Irregularities in the outer profile of the communications conduit can prevent a proper seal with the packer, thereby compromising the packer's function to isolate upper and lower borehole zones.

Former downhole gauge systems required the passage of the conduit through the port of the packer assembly followed by the attachment and connection of the gauge device to the distal end of the communications conduit once the packer was traversed. This was necessary because either the gauge assembly or the connection means between the conduit and the gauge typically had an outer profile that was larger than the communications conduit itself. The larger profiled gauge or connection means was unable to pass through the communications port designed to hydraulically seal against the smaller, more consistent communications conduit. Therefore, the communications conduit and the gauge assembly were typically delivered to the field location separately. Any functional checks that needed to be made on the gauge had to be performed prior to its final mating with the communications conduit and at the field location. As a result there was no way to test the integrity of the final conduit/gauge communications interface until after the gauge was installed below the packer, when a repair or replacement operation would be very costly.

SUMMARY OF THE INVENTION

The invention comprises a sensor gauge assembly to measure and communicate conditions from a downhole zone to a remote location through a downhole assembly. The sensor gauge may include a main body having an outer profile, a sensor package, and a connection to the communications conduit. The communications conduit may include a second outer profile and is configured to transmit communications data from the sensor package to the remote location. The connection to the communications conduit may include a third outer profile and the first, second, and third outer profiles are substantially the same.

The invention also comprises a sensor gauge assembly to measure and communicate conditions from a downhole zone to a remote location through a downhole assembly. The sensor gauge assembly may include a main body having a first outer diameter, a sensor package, and a connection to the communications conduit. The communications conduit may include a second outer diameter and is configured to transmit communications data from the sensor package to the remote location. The connection to the communications conduit has a third outer diameter and the first and third outer diameters are smaller than the second diameter.

The invention also comprises a communications system to measure and transmit data from a zone of interest below a packer to a surface location. The communications system preferably includes a communications conduit extending from the remote location to the zone of interest through a communications port of the packer. Preferably, a lower portion of the communications conduit has a substantially consistent outer gauge diameter wherein the lower portion is configured to be searingly engages with the communications port. The communications system preferably includes a sensor gauge connected to a distal end of the communications conduit by a seamlessly connection wherein the seamlessly connection and the sensor gauge preferably have concentric outer diameters equal to the outer gauge diameter.

The invention also comprises a method to communicate with a zone of interest below a downhole assembly. The method preferably includes deploying a sensor gauge upon a distal end of a communications conduit to the downhole assembly. The method preferably includes engaging the sensor gauge and the distal end of the communications conduit through a communications port of the downhole assembly. The method preferably includes engaging the communications conduit with hydraulic seals within the communications port to prevent leakage of fluids from the zone of interest. The method preferably includes suspending the sensor gauge below the downhole assembly wherein the sensor gauge is configured to measure conditions of the zone of interest. The method preferably includes communicating the conditions of the zone of interest from the sensor gauge to a remote location through the communications conduit. Preferably, the distal end of the communications conduit and the sensor gauge have a uniform and continuous outer diameter.

DETAILED DESCRIPTION OF THE PREFERRED EMBODIMENTS

Figure 1:
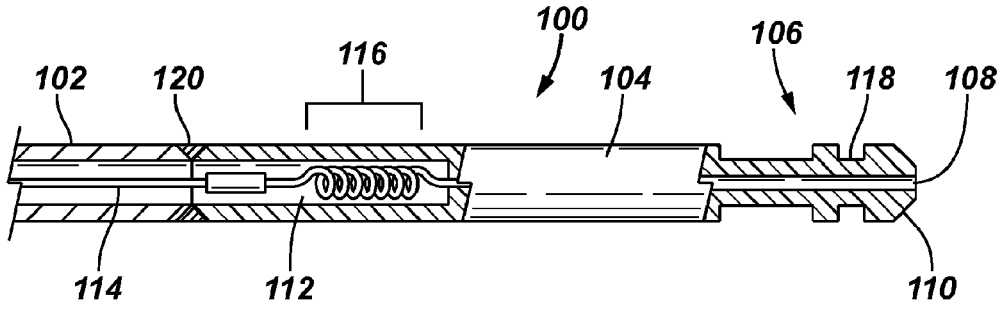
FIG. 1 is a schematic cross-sectional view of a sensor gauge assembly in accordance with an embodiment of the present invention.

Referring to FIG. 1, a sensor gauge 100 in accordance with the present invention is shown. Sensor gauge 100 is deployed at the end of a communications conduit 102 and includes a main body 104 and a stinger head 1 06. Sensor gauge 100 may be any type of gauge used to measure wellbore parameters, such as temperature, pressure, flow, vibration, fluid differentiation, chemical properties, among others. Communications conduit 102 can be constructed as an armored cable assembly or can be any type or design of communications conduit known to one skilled in the art, including, but not limited to a hydraulic conduit, fiber-optic conduit, pneumatic conduit, electrical conduit, or the like.

Stinger head 106 preferably includes a sensor port 108 and a stinger profile 110. Main body 104 can include any electronics or signal processing devices (not shown) and is shown having a cavity 112 through which a communications conductor 114 extends from the rear of main body 104 into communications conduit 102. A coil 116 of conductor wire 114 is preferably contained within cavity 112 to accommodate any displacement of or tension on conductor 114 relative to communications conduit 102. In addition to sensor port 108, stinger head 106 is shown having optional seal glands 118 to facilitate pressure testing of sensor gauge assembly 100 prior to deployment. Stinger profile 110 of stinger head 106 is preferably constructed to align and guide sensor gauge 100 through a clearance port in a packer or other downhole device. Sensor port 108 allows sensors contained within main body 104 to communicate with fluids coming into contact with stinger head 106.

Readings from sensor gauge assembly 100 through sensor port 108 are reported back either to electronics (not shown) in main body 104 or to a remote location at the end of communications conductor 114. If main body 104 contains sensor electronics to process the signals read from sensor port 108, conductor 114 can be used to transmit the processed signals from main body 104 to a remote location. For example, sensor electronics inside main body 104 can contain digital processors, so that communications conductor 114 extending from main body 104 to remote location through conduit 102 is a digital data path. While the term "conductor" is used, it is important that any communications mechanism, hydraulic, electrical, and optical, etc. May be employed for communications conductor 114 without departing from the spirit of the present invention.

Main body 104 of sensor gauge assembly 100 is preferably connected to communications conduit 102 at 120 through a seamless welded connection. Once sensor gauge assembly 100 is welded (or similarly attached through brazing, soldering, etc.) to communications conduit 102, the weld area 120 is ground down so that the transition between conduit 102 and main body 104 is geometrically insubstantial. As main body 104 is preferably constructed to have the same outer profile as that of communications conduit 102, the connection therebetween at weld area 120 is preferably made with the same profile. Once welded, the communications conduit 102 and sensor gauge assembly 100 can have a single uniform outer profile from a remote location all the way to the main body 104. Alternatively, to reduce costs, outer profile of communications conduit 102 can be uniform only along a length necessary to engage sensor gauge 100 through a piece of downhole equipment, for example, a packer.

The primary benefit of having a uniform outer profile along communications conduit 102 through main body 104 of sensor gauge 100 is that simple, standard, off-the-shelf seal mechanisms can be used to isolate sensor gauge 100 and conduit 102 from a piece of downhole equipment. For example, in a packer, a simple o-ring seal is sufficient to ensure a tight seal between the packer and the sensor gauge assembly 100 or communications conduit 102 (such as an o-ring disposed on seal gland 118).

Figure 2:
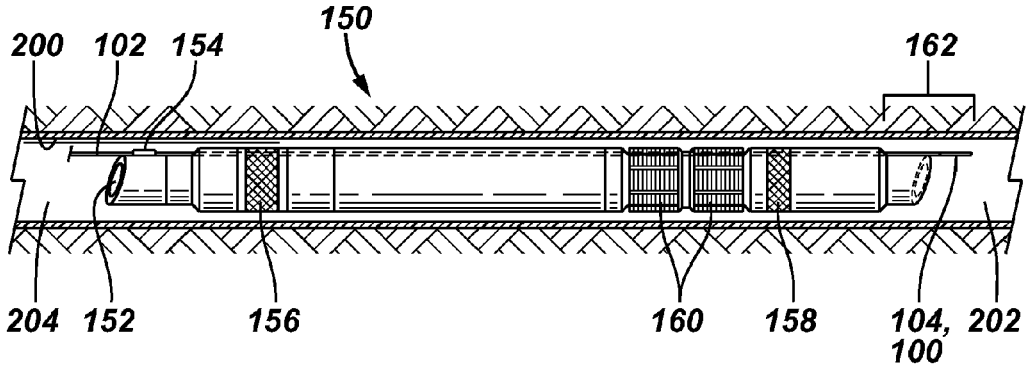
FIG. 2 is a schematic cross-sectional view of a sensor gauge assembly of FIG. 1 engaged through a downhole packer assembly.

Referring briefly to FIG. 2, a packer assembly 150 having a clearance bore 152 and a sensor gauge bore 154 therethrough is shown located in a cased wellbore 200. Packer 150 functions to isolate a lower zone 202 from an upper zone 204 through the actuation of packer elements 156,158 and anchors 160. With elements 156, 158 and anchors 160 actuated, any hydraulic communication between lower zone 202 and an upper zone (i.e. 204) or remote location must pass through bore 152. A string of tubing (not shown) typically connects bore 152 to the surface, allowing zone 204 to be isolated completely. Such isolation prevents fluids flowing from production zones like lower zone 202 from being contaminated by fluids in upper zones 204.

Packer 150 also includes a sensor gauge bore 154 through which a sensor gauge assembly 100 at the distal end of a communications conduit 102 can pass. Because conduit 102 and main body 104 of assembly 100 are preferably constructed having a consistent outer diameter profile, o-ring seals (not visible) are all that are needed to seal sensor gauge assembly 100 with packer 150 to keep zones 202 and 204 isolated. While any size can be used for sensor gauge assembly, a standard 0.25 inch (6.35 mm) outside diameter geometry is preferred. The sensor assembly 100 is delivered to the downhole location at the distal end of communications conduit 102 and is "stripped" through port 154 of packer until a length 162 of conduit 102 and sensor assembly 100 protrudes below packer 150 into lower zone 202. In this position, sensor port 108 of gauge assembly 100 is exposed to fluids in zone 202 and can report any information measured there back to a remote location.

Figure 3:
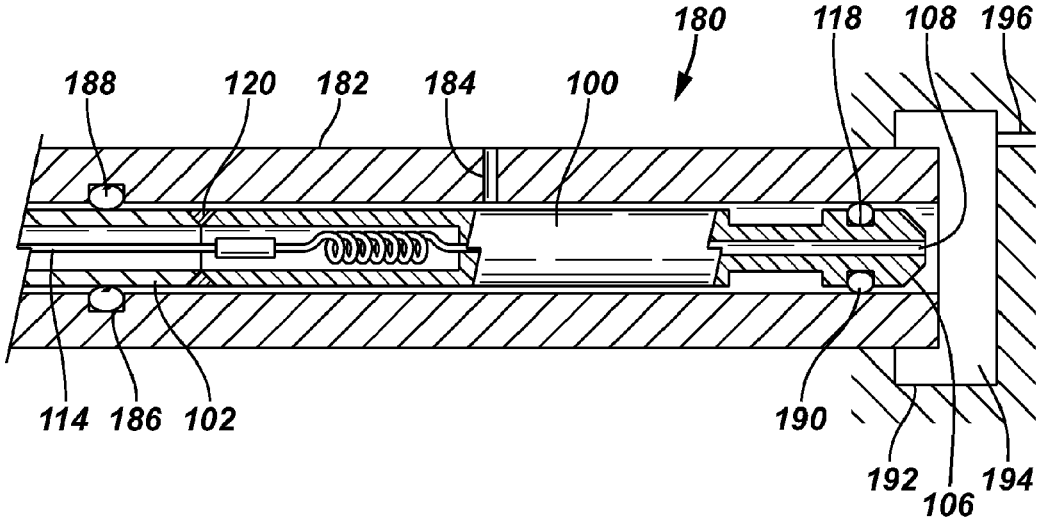
FIG. 3 is a schematic cross-sectional view of the sensor gauge assembly of FIG. 1 installed in a testing station.

Referring briefly to FIG. 3, a test station assembly 180 for sensor gauge assembly 100 is shown. Sensor test station 180 is shown having a simple cylindrical test body 182, a hydraulic port 184, and a seal gland 186. Elastomeric seals 188,190 help isolate communications conduit 102 and sensor gauge 100 from the atmosphere so that weld area interface 120 can be tested for hydraulic integrity. To perform the test, hydraulic pressure is applied to port 184 while sensor gauge 100 is plugged into a monitoring unit (not shown). As pressure to port 184 is increased, that pressure acts upon weld area 120 and the monitoring unit can detect any rupture or leak. Furthermore, if sensor gauge 100 includes a pressure gauge, a pressure cap 192 can be located upon the distal end of test body 182 so that pressure can be increased in a test volume 194 through a second hydraulic port 196. Isolating the stinger head 110 of sensor gauge 100 allows different pressures to be applied to weld area 120 and sensor port 108 to test and certify sensor gauge 100 at a broad range of operating pressures.

Formerly, sensor gauges were delivered to the rigsite in components and either assembled downhole or immediately before being run downhole. Using the former systems, the cable and sensor included a connector mechanism that was of considerably larger diameter than the cable and sensor assembly to be connected. Therefore, if a 0.25 inch (6.35 mm) conduit were connected to a 0.25 inch (6.35 mm) sensor gauge, the connection means would prevent the assembly from passing through a 0.25 inch (6.35 mm) port. Furthermore, as the connection between gauge and conduit was often made after the conduit was run down hole, there was no way to test the integrity of the connection prior to deployment. The assembly could be put together and tested prior to deployment, but was still disassembled prior to installation. Using the apparatuses and methods of the present invention, a communications conduit and attached sensor gauge can be stripped through a seal bore designed to accommodate 0.25 inch (6.35 mm) diameter conduits.

Furthermore, the present invention enables a unitary communications conduit and sensor gauge manufacturable to a high degree of tolerance. Particularly, geometric dimensioning and tolerancing (GD&T) standards for cylindricity (radial deviations along a cylindrical feature) as high as ±0.005 inches (±0.127 mm) are feasible. Additionally, using the apparatus and methods of the present invention, any deficiencies of the prior art are addressed and corrected. A cable/sensor assembly can be constructed and tested in a controlled environment and shipped to the rigsite ready to deploy on a large drum. Once at the rigsite, the integrity of the sensor/cable connection can be quickly and easily tested immediately prior to installation.

Numerous embodiments and alternatives thereof have been disclosed. While the above disclosure includes the best mode belief in carrying out the invention as contemplated by the inventors, not all possible alternatives have been disclosed. For that reason, the scope and limitation of the present invention is not to be restricted to the above disclosure, but is instead to be defined and construed by the appended claims.

What is claimed is:

1. A sensor gauge assembly to measure and communicate conditions from a downhole zone to a remote location though a downhole assembly, the assembly comprising a main body having a first outer profile, a sensor package, and a seamless connection to a communications conduit;

wherein the communications conduit has a second outer profile and is configured to transmit communications data from the sensor package to the remote location, the connection to the communications conduit has a third outer profile, and said first, second, and third outer profiles have substantially the same diameter.

2. The sensor gauge assembly of claim 1, wherein the first, second, and third outer profiles are concentric outer diameters.

3. The sensor gauge assembly of claim 2, wherein the concentric outer diameters are 0.250 inches (6.350 mm).

4. The sensor gauge assembly of claim 2, wherein the concentric outer diameters have a geometric dimensioning and tolerancing cylindricity tolerance of ±0.005 inches (±0.127 mm).

5. The sensor gauge assembly of claim 1, wherein the communications conduit is selected from the group consisting of shielded cable, unshielded cable, fiber optic cable, hydraulic tubing, capillary tubing, wireline, and slick line.

6. The sensor gauge assembly of claim 1, wherein the downhole assembly is a packer.

7. The sensor gauge assembly of claim 6, wherein the packer includes a bypass port to allow the sensor gauge assembly to bypass a packer element independent of a main clearance bore of said packer.

8. The sensor gauge assembly of claim 1, wherein the connection to the communications conduit includes a welded connection.

9. The sensor gauge assembly of claim 1, wherein the connection to said communications conduit includes a brazed connection.

10. The sensor gauge assembly of claim 1, wherein the connection to said communications conduit includes a soldered connection.

11. The sensor gauge assembly of claim 1, wherein the connection to said communications conduit includes a threaded connection.

12. The sensor gauge assembly of claim 1, wherein the sensor package is configured to measure temperature in said downhole zone.

13. The sensor gauge assembly of claim 1, wherein the sensor package is configured to measure pressure in said downhole zone.

14. A sensor gauge assembly to measure and communicate conditions from a downhole zone to a remote location through a downhole assembly, the sensor gauge assembly comprising a main body having a first outer diameter, a sensor package, and a seamless connection to a communications conduit;

wherein the communications conduit has a second outer diameter and is configured to transmit communications data from the sensor package to the remote location, the connection to the communications conduit has a third outer diameter, and the first and third outer diameters are smaller than said second diameter.

15. The sensor gauge assembly of claim 14, wherein the second outer diameter is 0.25 inches (6.35 mm).

16. The sensor gauge assembly of claim 14, wherein the downhole assembly is a packer.

17. A communications system to measure and transmit data from a zone of interest below a packer to a remote location, the communications system comprising:

a communications conduit extending from the remote location to the zone of interest though a communications port of the packer, a lower portion of said communications conduit having a substantially consistent outer gauge diameter, said lower portion being configured to be sealingly engaged within said communications port; and a sensor gauge seamlessly connected to the distal end of said communications conduit;

the seamless connection and said sensor gauge having outer diameters concentric with and equal to said outer gauge diameter.

18. The communications system of claim 17, wherein said outer gauge diameter is 0.250 inches (6.350 mm).

19. The communications system of claim 18, wherein said outer gauge diameter has a manufacturing tolerance of ±0.005 inches (0.127 mm).

20. The communications system of claim 17, wherein said seamless connection includes a weld.

21. The communications system of claim 17, wherein said seamless connection includes a threaded connection.

22. The communications system of claim 17, wherein said communications conduit is selected from the group consisting of shielded cable, unshielded cable, fiber optic cable, hydraulic tubing, capillary tubing, wireline, and slick line.

23. A method of communicating with a zone of interest below a downhole assembly, the method comprising:

deploying a sensor gauge upon a distal end of a communications conduit to the downhole assembly;

engaging the sensor gauge and the distal end of the communications conduit through a communications port of the downhole assembly;

engaging the communications conduit with hydraulic seals within the communications port to prevent leakage of fluids from the zone of interest;

suspending the sensor gauge below the downhole assembly, the sensor gauge being configured to measure conditions of the zone of interest; and communicating the conditions of the zone of interest from the sensor gauge to a remote location though the communications conduit;

wherein the distal end of the communications conduit and the sensor gauge have a uniform, continuous outer diameter.

24. The method of claim 23, wherein the downhole assembly is a packer.

25. The method of claim 23, wherein the continuous outer diameter is 0.250 inches (6.350 mm).

26. The method of claim 23, wherein the continuous outer diameter has a geometric dimensioning and tolerancing cylindricity of ±0.005 inches (±0.127 mm).

27. The method of claim 23, wherein the hydraulic seals are elastomeric o-rings.

28. The method of claim 23, further including pressure testing the integrity of an interface between the distal end of the communications conduit and the sensor gauge.

29. The method of claim 23, further including delivering the communications conduit and the sensor gauge to a rig site in an assembled state.

* * * * *